US011123591B2

(12) United States Patent
Thomas

(10) Patent No.: US 11,123,591 B2
(45) Date of Patent: Sep. 21, 2021

(54) PLANK EXERCISE MODIFIER ASSEMBLY

(71) Applicant: Daniel Thomas, Ashland, OH (US)

(72) Inventor: Daniel Thomas, Ashland, OH (US)

( * ) Notice: Subject to any disclaimer, the term of this patent is extended or adjusted under 35 U.S.C. 154(b) by 23 days.

(21) Appl. No.: 16/801,959

(22) Filed: Feb. 26, 2020

(65) Prior Publication Data

US 2021/0260432 A1 Aug. 26, 2021

(51) Int. Cl.
*A63B 21/002* (2006.01)
*A63B 21/00* (2006.01)

(52) U.S. Cl.
CPC ..... *A63B 21/0023* (2013.01); *A63B 21/0004* (2013.01); *A63B 21/4015* (2015.10); *A63B 21/00047* (2013.01); *A63B 2208/0257* (2013.01)

(58) Field of Classification Search
CPC ..... A63B 21/0004; A63B 21/00058; A63B 21/00061; A63B 21/00065; A63B 21/00178; A63B 21/00185; A63B 21/002; A63B 21/0023; A63B 21/06; A63B 21/0601; A63B 21/0615; A63B 21/0618; A63B 21/068; A63B 21/22; A63B 21/4011; A63B 21/4015; A63B 21/4033; A63B 21/4034; A63B 21/4047; A63B 21/4049; A63B 22/0056; A63B 22/0064; A63B 22/16; A63B 22/18; A63B 22/20; A63B 22/203
See application file for complete search history.

(56) References Cited

U.S. PATENT DOCUMENTS

| | | | | |
|---|---|---|---|---|
| 7,156,788 | B1 | 1/2007 | Jackson | |
| 7,367,928 | B2 | 5/2008 | Storch | |
| 7,658,702 | B1 | 2/2010 | Harms | |
| D622,789 | S * | 8/2010 | Gillis | D21/685 |
| 7,909,746 | B2 * | 3/2011 | Gant | A63B 21/4019 482/141 |
| 8,430,796 | B1 * | 4/2013 | Tarkington | A63B 23/03541 482/51 |
| 9,056,222 | B2 | 6/2015 | Thomason | |
| 9,669,255 | B2 * | 6/2017 | Henniger | A63B 21/00047 |
| D836,851 | S * | 12/2018 | Bartz | D30/127 |
| 10,821,325 | B2 * | 11/2020 | Trevino | A63B 23/03525 |
| 2011/0269605 | A1 * | 11/2011 | Kim | A63B 22/14 482/121 |
| 2014/0296046 | A1 | 10/2014 | Doubilet | |
| 2016/0220862 | A1 | 8/2016 | Johnson | |
| 2016/0263425 | A1 | 9/2016 | Carney | |
| 2018/0006498 | A1 | 3/2018 | Domesick | |
| 2020/0147439 | A1 * | 5/2020 | Acuna, Jr. | A63B 23/03575 |
| 2020/0282259 | A1 * | 9/2020 | Olmstead | A63B 43/02 |

* cited by examiner

*Primary Examiner* — Garrett K Atkinson
*Assistant Examiner* — Zachary T Moore

(57) ABSTRACT

A plank exercise assembly for performing a plank exercise includes a panel that has a curved portion that can be positioned on a support surface. A block is coupled to and extends perpendicularly away from the panel and a pair of foot pegs is coupled to and extending perpendicularly away from the block in opposite directions from each other. Each of the foot pegs has a respective one of a user's feet is positioned between the foot pegs and the panel to position the user's feet in a preferred orientation for performing a plank exercise. A pair of wedges is each coupled to the panel on an opposite side of the panel from the block. Each of the wedges has a sloped surface with respect to the panel that rests on the support surface when the panel is positioned in a ready position.

12 Claims, 5 Drawing Sheets

PLANK EXERCISE MODIFIER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for performing a plank exercise.

(2) Description of Related Art Including Information Disclosed Under 37 CFR 1.97 and 1.98

The prior art relates to exercise devices. The prior art discloses a variety of exercise devices, each including a stanchion, to assist a user with performing body presses. Additionally, the prior art discloses an exercise device that includes a stand upon which a user's feet can be positioned for performing push-ups and plank exercises. The prior art discloses a variety of exercise devices, each having a novel structure with respect to each other, that generally facilitate a hand grip for performing body presses. The prior art discloses a foot panel that is pivotally mounted to a base thereby facilitating a user to position their feet in the foot panel for performing plank exercises.

BRIEF SUMMARY OF THE INVENTION

An embodiment of the disclosure meets the needs presented above by generally comprising a panel that has a curved portion that can be positioned on a support surface. A block is coupled to and extends perpendicularly away from the panel and a pair of foot pegs is coupled to and extending perpendicularly away from the block in opposite directions from each other. Each of the foot pegs has a respective one of a user's feet is positioned between the foot pegs and the panel to position the user's feet in a preferred orientation for performing a plank exercise. A pair of wedges is each coupled to the panel on an opposite side of the panel from the block. Each of the wedges has a sloped surface with respect to the panel that rests on the support surface when the panel is positioned in a ready position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
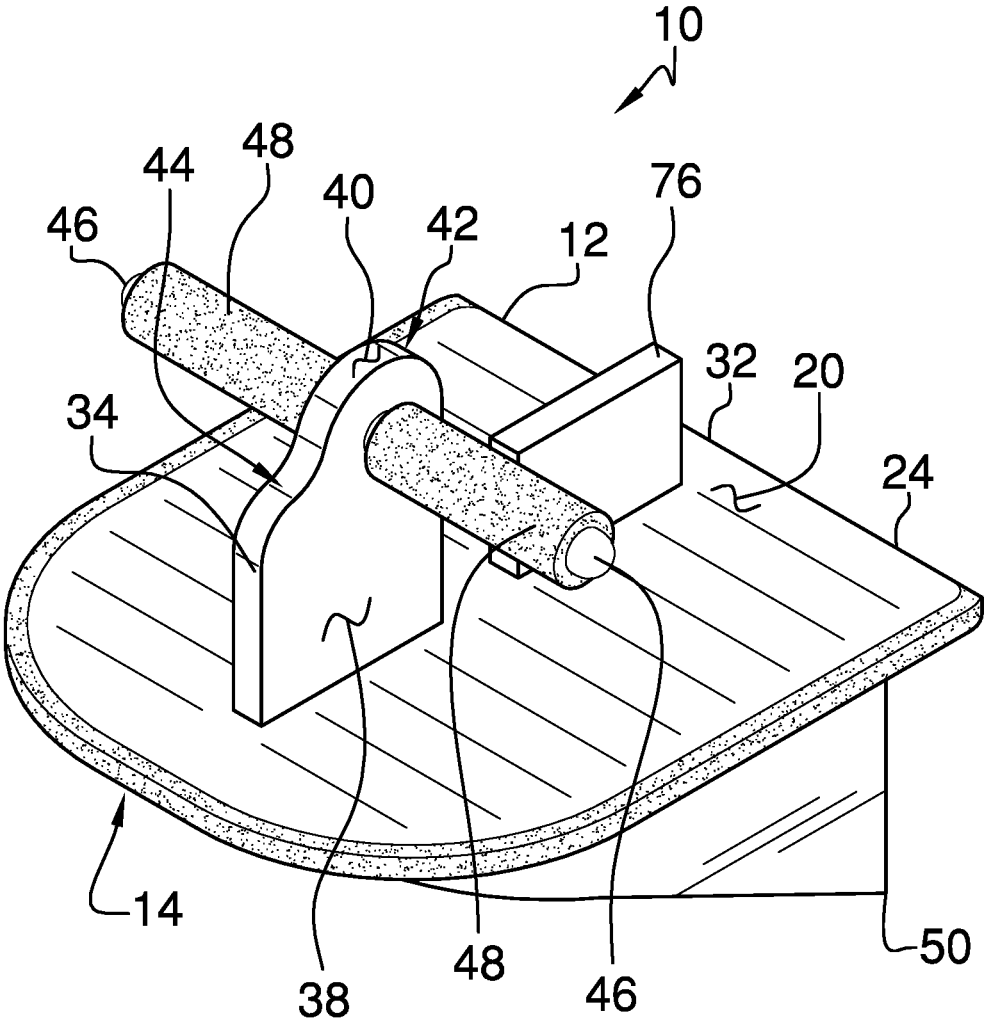
FIG. 1 is a front perspective view of a plank exercise modifier assembly according to an embodiment of the disclosure.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the plank exercise modifier assembly 10 generally comprises a panel 12 that has a curved portion 14 and the curved portion 14 is positionable on a support surface 16. The support surface 16 may be a floor or other horizontal support surface upon which a user 18 can stand. The panel 12 has a front surface 20, a back surface 22 and a perimeter edge 24 extending therebetween, and the perimeter edge 24 has a first lateral side 26, a second lateral side 28, a front side 30 and a back side 32. Moreover, the front side 30 is convexly arcuate between each of the first lateral side 26 and the second lateral side 28 to define the curved portion 14 of the panel 12. The back side 32 of the perimeter edge 24 has a rod well 33 extending toward the front side 30 of the perimeter edge 24, and the rod well 33 is centrally positioned along the back side 32.

Each of the first lateral side 26, the second lateral side 28 and the front side 30 is comprised of a resilient material to resist being degraded by friction. The resilient material may comprise high impact plastic, polyvinylchloride or any other material that can resist abrasion. Additionally, the front surface 20 is textured for enhancing gripping the front surface 20. The texture of the front surface 20 may be rendered by a plurality of grooves cut into the front surface 20, a non-slip pad bonded to the front surface 20 or any other conventional means of texturing a surface for enhancing grip of soles on tennis shoes or the like.

A block 34 is coupled to and extends perpendicularly away from the panel 12. The block 34 is positioned on the front surface 20 of the panel 12 and the block 34 has a first lateral surface 36, a second lateral surface 38 and a distal surface 40 with respect to the front surface 20 of the panel 12. The block 34 is oriented to extend along an axis is oriented parallel to the first lateral side 26 and the second lateral side 28 of the perimeter edge 24 of the panel 12. The block 34 is centrally positioned on the panel 12 and the block 34 is positioned adjacent to the front side 30 of the perimeter edge 24 of the panel 12. As is most clearly shown in FIGS. 1 and 3, the distal surface 40 has a convex portion 42 with respect to the front surface 20 of the panel 12 and a concave portion 44 with respect to the front surface 20 of the panel 12.

A pair of foot pegs 46 is provided and each of the foot pegs 46 is coupled to and extends perpendicularly away from the block 34 in opposite directions from each other. Each of the foot pegs 46 is spaced from the panel 12 thereby facilitating the user 18 to position each of their feet between the foot pegs 46 and the panel 12. In this way the panel 12 positions the user 18's feet in a preferred orientation for performing a plank exercise. Each of the foot pegs 46 extends away from a respective one of the first lateral surface 36 or the second lateral surface 38 of the block 34, and each of the foot pegs 46 is positioned adjacent to the distal surface 40 of the block 34. A pair of cushions 48 is provided and each of the cushions 48 is positioned around a respective one of the foot pegs 46. Each of the cushions 48 is comprised of a resiliently compressible material to enhance comfort for the user 18. Additionally, each of the cushions 48 extends substantially along the length of the respective foot peg 46.

A pair of wedges 50 is provided and each of the wedges 50 is coupled to the panel 12 on an opposite side of the panel 12 from the block 34. Each of the wedges 50 has a sloped surface 52 with respect to the panel 12 and the sloped surface 52 of each of the wedges 50 rests on the support surface 16 when the panel 12 is positioned in a ready position. In this way the pair of wedges 50 retains the panel 12 at a preferred angle for positioning the user 18's feet beneath the pair of foot pegs 46.

Each of the wedges 50 has a first end 54, a second end 56 and a coupled surface 58 extending therebetween, and the coupled surface 58 of each of the wedges 50 is coupled to the back surface 22 of the panel 12. The sloped surface 52 of each of the wedges 50 angles away from the back surface 22 of the panel 12 between the second end 56 and the first end 54 of the wedges 50. The coupled surface 58 of each of the wedges 50 is curved between the first end 54 and the second end 56, and each of the wedges 50 extends substantially between the front side 30 and the back side 32 of the perimeter edge 24 of the panel 12. The wedges 50 are spaced apart from each other having the second end 56 of each of the wedges 50 being directed toward each other.

A pair of engagements 60 is provided and each of the engagements 60 is pivotally coupled to a respective one of the wedges 50. Each of the engagements 60 has a respective end 62 of a carrying strap 64 being removably coupled thereto for carrying the panel 12. Moreover, each of the engagements 60 is positioned on an outwardly facing surface 66 of the respective wedge 50 and each of the engagements 60 is positioned adjacent to the first end 54 of the respective wedge 50. Each of the engagements 60 may comprise a D-ring that is pivotally coupled to the respective wedge 50, an eye bolt that engages the respective wedge 50 or any other type of engagement that clasps can engage and release.

Figure 2:
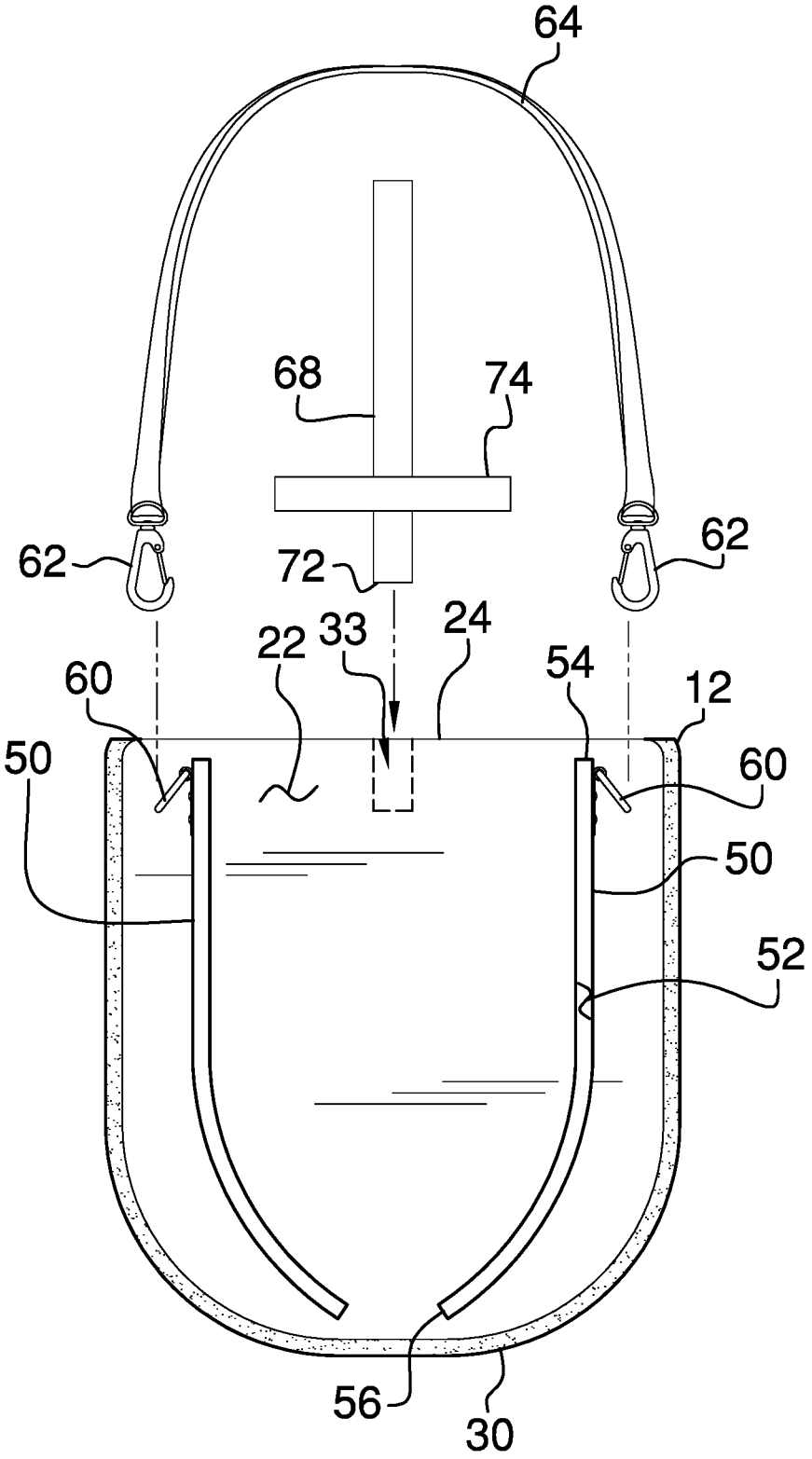
FIG. 2 is a back view of an embodiment of the disclosure.
Figure 3:
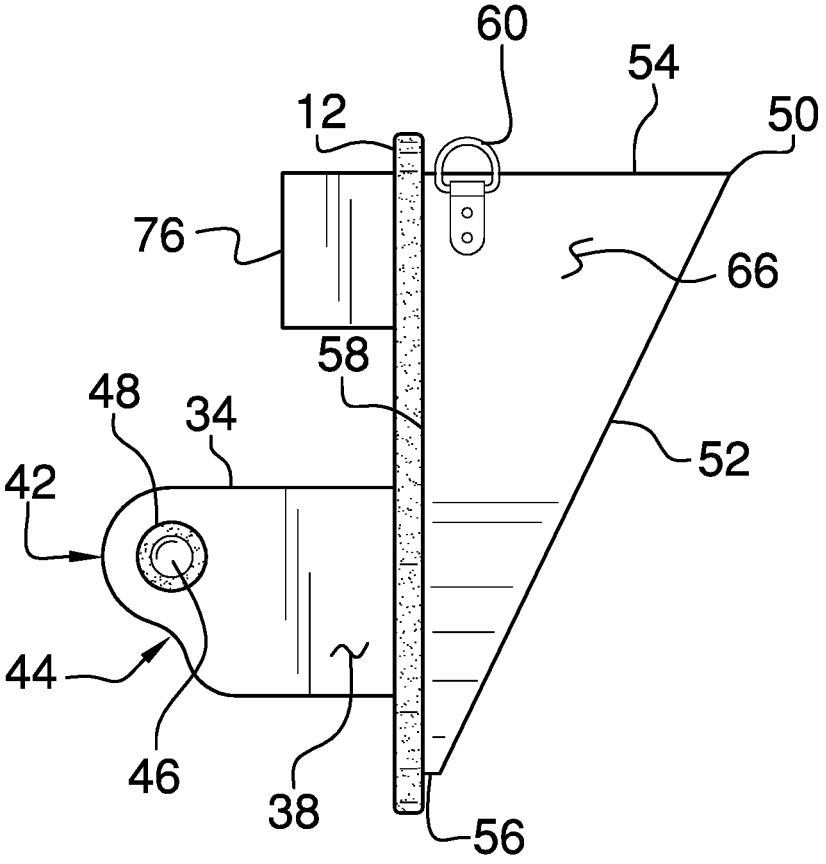
FIG. 3 is a right side view of an embodiment of the disclosure.
Figure 4:
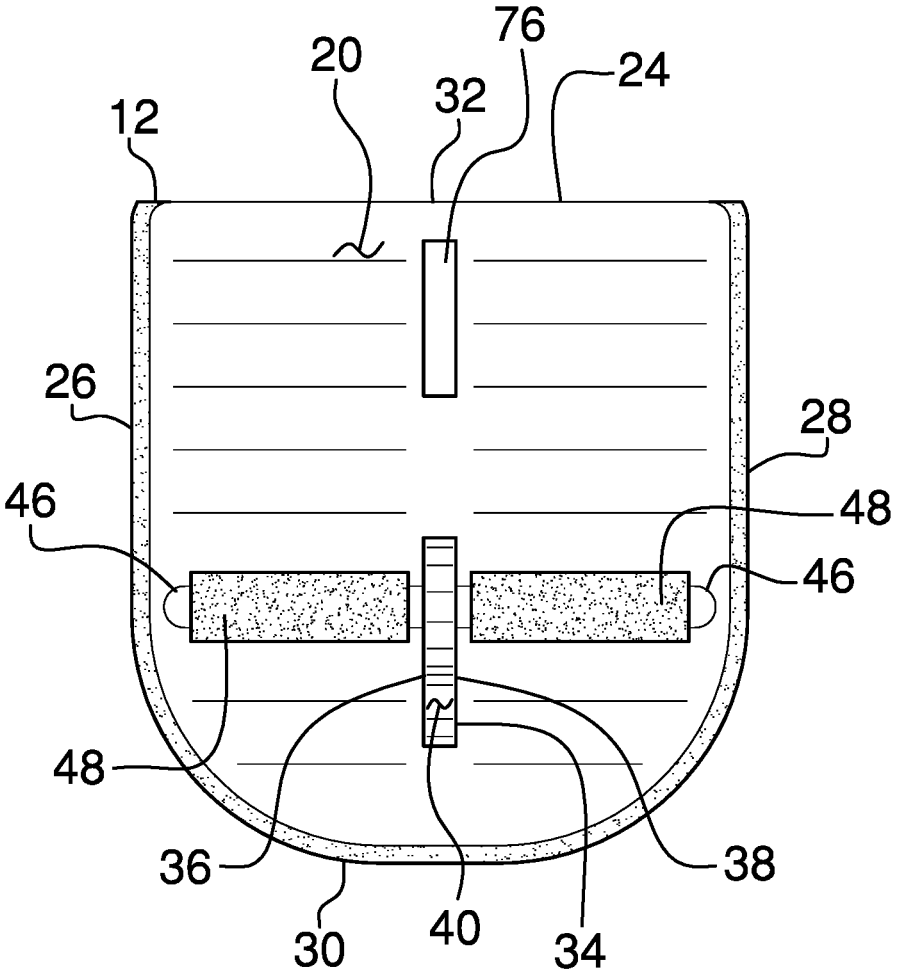
FIG. 4 is a front view of an embodiment of the disclosure.
Figure 5:
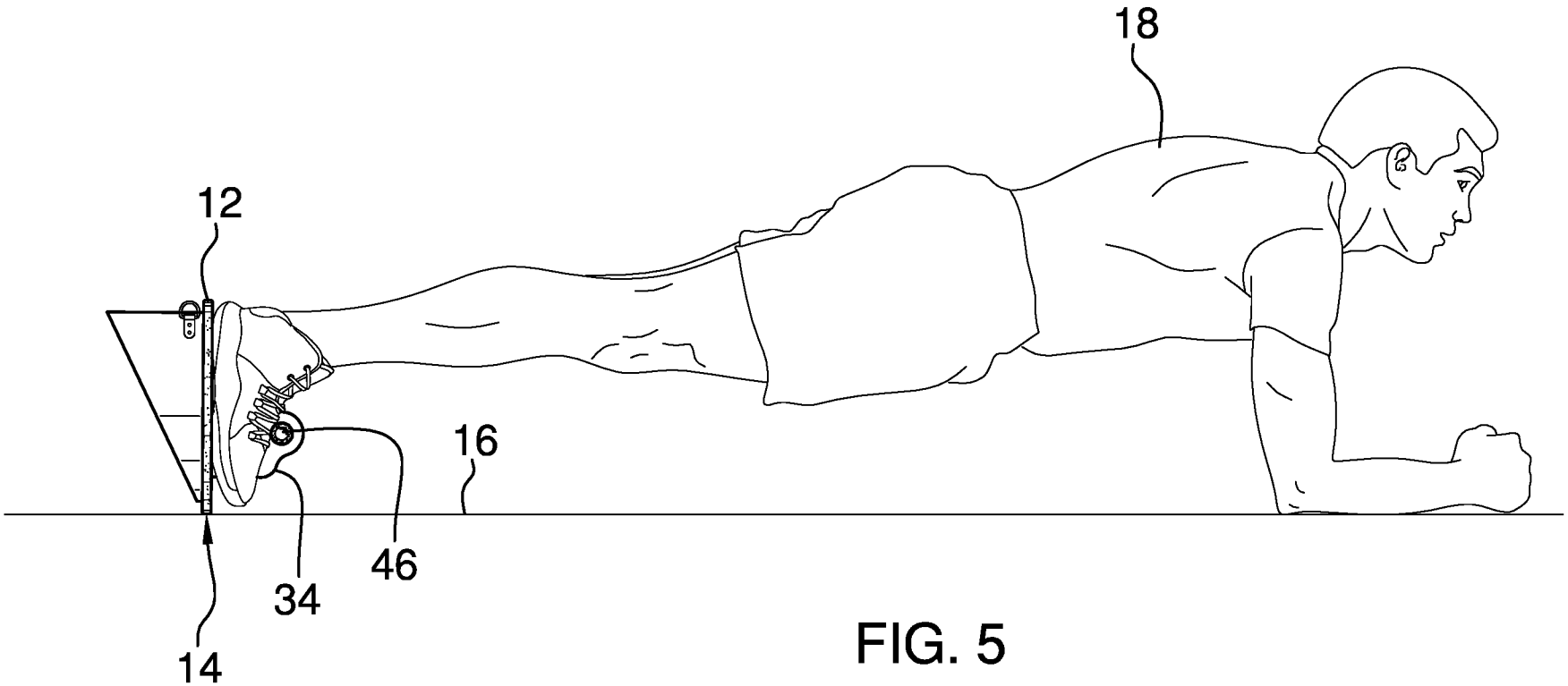
FIG. 5 is a perspective in-use view of an embodiment of the disclosure.

As is most clearly shown in FIG. 2, a weight rod 68 is provided and the weight rod 68 is removably attachable to the panel for increasing difficulty of the plank exercise. The weight rod 68 has an insertion end 72 and the insertion end 72 is insertable into the rod well 33. A weight 74 is positionable around the weight rod 68 to increase resistance placed on the user's back muscles while performing the plank exercise. The weight 74 may have a weight ranging between approximately 2.5 kg and 11.0 kg and the weight 74 may comprise a barbell plate or the like. A fin 76 is coupled to and extends away from the front surface 20 of the panel 12 and the fin 76 is oriented to extend along a line extending through the front side 30 and the back side 32 of the perimeter edge 24 of the panel 12. Additionally, the fin 76 is aligned with the block 34 thereby facilitating the fin 76 to be aligned with the user's heels 78 when the user is performing the plank exercise.

In use, the panel 12 is positioned on the support surface 16 having the sloped surface 52 of each of the wedges 50 resting on the support surface 16. The user 18 positions each of their feet between the respective foot peg and the front surface 20 of the panel 12. Moreover, the panel 12 rocks upwardly to rest on the front side 30 of the perimeter edge 24 of the panel 12. In this way the user 18's feet are positioned in the preferred orientation for performing the plank exercise. Additionally, the curvature of the front side 30 forces the user 18 to engage lower back muscles to inhibit the panel 12 from rolling sideways on the support surface 16. In this way the panel 12 facilitates greater therapeutic benefits from performing the plank exercise. Additionally, the weight rod 68 can be inserted into the panel 12 and the weight 74 can be placed on the weight rod 68 to increase resistance of the plank exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plank exercise assembly being configured to support a user's feet in a preferred orientation while performing a plank exercise, said assembly comprising:

a panel having a curved portion wherein said curved portion is configured to be positioned on a support surface;

a block being coupled to and extending perpendicularly away from said panel;

a pair of foot pegs, each of said foot pegs being coupled to and extending perpendicularly away from said block in opposite directions from each other, each of said foot pegs being spaced from said panel, each of said foot pegs configured to have a respective one of a user's feet positioned between said foot pegs and said panel wherein said panel is configured to position the user's feet in a preferred orientation for performing a plank exercise;

a pair of wedges, each of said wedges being coupled to said panel on an opposite side of said panel from said block, each of said wedges having a sloped surface with respect to said panel, said sloped surface of each of said wedges resting on the support surface when said panel is positioned in a ready position wherein said pair of wedges is configured to retain said panel at a preferred angle for positioning the user's feet beneath said pair of foot pegs;

a pair of engagements, each of said engagements being pivotally coupled to a respective one of said wedges, each of said engagements having a respective end of a carrying strap being removably coupled thereto for carrying said panel; and a weight rod being removably attachable to said panel for increasing difficulty of the plank exercise.

2. The assembly according to claim 1, further comprising said panel has a front surface, a back surface and a perimeter edge extending therebetween, said perimeter edge having a first lateral side, a second lateral side, a front side and a back side, said front side being convexly arcuate between each of said first lateral side and said second lateral side to define said curved portion of said panel, each of said first lateral side, said second lateral side and said front side being comprised of a resilient material wherein said first lateral side, said second lateral side and said front side are configured to resist being degraded by friction, said front surface being textured for enhancing gripping said front surface.

3. The assembly according to claim 2, wherein said back side of said perimeter edge has a rod well extending toward said front side of said perimeter edge, said rod well being centrally positioned along said back side.

4. The assembly according to claim 3, wherein said weight rod has a first end and a second end, said first end being insertable into said rod well.

5. The assembly according to claim 4, further comprising a weight being positionable around said weight rod wherein said weight is configured to increase resistance placed on the user's back muscles while performing the plank exercise.

6. The assembly according to claim 2, wherein said block is positioned on said front surface of said panel, said block having a first lateral surface, a second lateral surface and a distal surface with respect to said front surface of said panel, said block being oriented to extend along an axis being oriented parallel to said first lateral side and said second lateral side of said perimeter edge of said panel, said block being centrally positioned on said panel, said block being positioned adjacent to said front side of said perimeter edge of said panel.

7. The assembly according to claim 6, wherein each of said foot pegs extends away from a respective one of said first lateral surface or said second lateral surface of said block, each of said foot pegs being positioned adjacent to said distal surface of said block.

8. The assembly according to claim 2, wherein each of said wedges has a first end, a second end and a coupled surface extending therebetween, said coupled surface of each of said wedges being coupled to said back surface of said panel, said sloped surface of each of said wedges angling away from said back surface of said panel between said second end and said first end of said wedges.

9. The assembly according to claim 8, wherein said coupled surface of each of said wedges is curved between said first end and said second end, each of said wedges extending between said front side and said back side of said perimeter edge of said panel, said wedges being spaced apart from each other having said second end of each of said wedges being directed toward each other.

10. The assembly according to claim 8, wherein each of said engagements is positioned on an outwardly facing surface of said respective wedge, each of said engagements being positioned adjacent to said first end of said respective wedge.

11. The assembly according to claim 1, further comprising a pair of cushions, each of said cushions being positioned around a respective one of said foot pegs, each of said cushions being comprised of a resiliently compressible material wherein each of said cushions is configured to enhance comfort for the user, each of said cushions extending along the length of said respective foot peg.

12. A plank exercise assembly being configured to support a user's feet in a preferred orientation while performing a plank exercise, said assembly comprising:

a panel having a curved portion wherein said curved portion is configured to be positioned on a support surface, said panel having a front surface, a back surface and a perimeter edge extending therebetween, said perimeter edge having a first lateral side, a second lateral side, a front side and a back side, said front side being convexly arcuate between each of said first lateral side and said second lateral side to define said curved portion of said panel, each of said first lateral side, said second lateral side and said front side being comprised of a resilient material wherein said first lateral side, said second lateral side and said front side are configured to resist being degraded by friction, said front surface being textured for enhancing gripping said front surface, said back side of said perimeter edge has a rod well extending toward said front side of said perimeter edge, said rod well being centrally positioned along said back side;

a block being coupled to and extending perpendicularly away from said panel, said block being positioned on said front surface of said panel, said block having a first lateral surface, a second lateral surface and a distal surface with respect to said front surface of said panel, said block being oriented to extend along an axis being oriented parallel to said first lateral side and said second lateral side of said perimeter edge of said panel, said block being centrally positioned on said panel, said block being positioned adjacent to said front side of said perimeter edge of said panel;

a pair of foot pegs, each of said foot pegs being coupled to and extending perpendicularly away from said block in opposite directions from each other, each of said foot pegs being spaced from said panel, each of said foot pegs configured to have a respective one of a user's feet being positioned between said foot pegs and said panel wherein said panel is configured to position the user's feet in a preferred orientation for performing a plank exercise, each of said foot pegs extending away from a respective one of said first lateral surface or said second lateral surface of said block, each of said foot pegs being positioned adjacent to said distal surface of said block;

a pair of cushions, each of said cushions being positioned around a respective one of said foot pegs, each of said cushions being comprised of a resiliently compressible material wherein each of said cushions is configured to enhance comfort for the user, each of said cushions extending along the length of said respective foot peg;

a pair of wedges, each of said wedges being coupled to said panel on an opposite side of said panel from said block, each of said wedges having a sloped surface with respect to said panel, said sloped surface of each of said wedges resting on the support surface when said panel is positioned in a ready position wherein said pair of wedges is configured to retain said panel at a preferred angle for positioning the user's feet beneath said pair of foot pegs, each of said wedges having a first end, a second end and a coupled surface extending therebetween, said coupled surface of each of said wedges being coupled to said back surface of said panel, said sloped surface of each of said wedges angling away from said back surface of said panel between said second end and said first end of said wedges, said coupled surface of each of said wedges being curved between said first end and said second end, each of said wedges extending between said front side and said back side of said perimeter edge of said panel, said wedges being spaced apart from each other having said second end of each of said wedges being directed toward each other;

a pair of engagements, each of said engagements being pivotally coupled to a respective one of said wedges, each of said engagements having a respective end of a carrying strap being removably coupled thereto for carrying said panel, each of said engagements being positioned on an outwardly facing surface of said respective wedge, each of said engagements being positioned adjacent to said first end of said respective wedge;

a weight rod being removably attachable to said panel for increasing difficulty of the plank exercise, said weight rod having a first end and a second end, said first end being insertable into said rod well; and a weight being positionable around said weight rod wherein said weight is configured to increase resistance placed on the user's back muscles while performing the plank exercise.

* * * * *